US007996944B2

(12) United States Patent
Kollegger

(10) Patent No.: US 7,996,944 B2
(45) Date of Patent: Aug. 16, 2011

(54) TILT-LIFT METHOD FOR ERECTING A BRIDGE

(75) Inventor: Johann Kollegger, Klosterneuburg (AT)

(73) Assignees: Kollegger GmbH, Klosterneuburg (AT); Austria Wirtschaftsservice GmbH, Vienna (AT)

( * ) Notice: Subject to any disclaimer, the term of this patent is extended or adjusted under 35 U.S.C. 154(b) by 140 days.

(21) Appl. No.: 12/438,342

(22) PCT Filed: May 21, 2007

(86) PCT No.: PCT/AT2007/000240

§ 371 (c)(1), (2), (4) Date: Mar. 10, 2009

(87) PCT Pub. No.: WO2008/022359

PCT Pub. Date: Feb. 28, 2008

(65) Prior Publication Data

US 2009/0313771 A1 Dec. 24, 2009

(30) Foreign Application Priority Data

Aug. 23, 2006 (DE) ..... 10 2006 039 551

(51) Int. Cl.
*E01D 21/00* (2006.01)

(52) U.S. Cl. ..... 14/77.1; 14/43

(58) Field of Classification Search ..... 14/2, 31–42, 14/77.1

See application file for complete search history.

(56) References Cited

U.S. PATENT DOCUMENTS

| | | | | | |
|---|---|---|---|---|---|
| 2,040,445 | A * | 5/1936 | Sakamoto | 14/42 |
| 2,482,562 | A * | 9/1949 | Shoemaker | 14/42 |
| 3,394,420 | A * | 7/1968 | Popov | 14/42 |
| 4,169,296 | A * | 10/1979 | Wipkink et al. | 14/71.1 |
| 4,296,516 | A * | 10/1981 | Jarnum | 14/71.7 |
| 4,473,916 | A * | 10/1984 | Connold | 14/42 |
| 4,535,498 | A * | 8/1985 | Webster | 14/18 |
| 5,044,829 | A * | 9/1991 | Hemminger | 405/203 |
| 5,421,051 | A * | 6/1995 | Patten | 14/37 |
| 5,454,127 | A * | 10/1995 | Dvorak et al. | 14/19 |
| 5,915,423 | A * | 6/1999 | Thomas | 14/2.4 |
| 7,020,924 | B2 * | 4/2006 | Cragg | 14/35 |
| 7,409,807 | B2 * | 8/2008 | Russell | 52/745.11 |
| 7,557,510 | B2 * | 7/2009 | Ghilardi | 314/31 |
| 2004/0045253 | A1 | 3/2004 | Russell | |

FOREIGN PATENT DOCUMENTS

| | | | |
|---|---|---|---|
| DE | 2422984 | A1 | 1/1975 |
| DE | 19747109 | A1 | 5/1999 |
| EP | 0 023 132 | | 1/1981 |
| JP | 03025107 | A | 2/1991 |
| JP | 04237773 | A | 8/1992 |
| JP | 2000-045229 | A | 2/2000 |

OTHER PUBLICATIONS

Beton im Form, "Bogenbrücke in Neuartigem Klappverfahren", Offizielles Organ des Bundesverbandes der Deutschen Zementindustrie e. V.; Mai 1984, p. 200, Heft 5, 34. Jahrgang.

* cited by examiner

*Primary Examiner* — Raymond W Addie
(74) *Attorney, Agent, or Firm* — Workman Nydegger

(57) ABSTRACT

One bridge pier, two bridge girders and two supporting rods are manufactured in an approximately vertical position. The supporting rods are connected to the top of the pier and to the bridge girders. The bridge girders are brought into the horizontal final position by raising the end points of the bridge girders, which end points are located beside the pier. Finally, the end points (9) of the bridge girders are connected to the pier.

19 Claims, 12 Drawing Sheets

TILT-LIFT METHOD FOR ERECTING A BRIDGE

The invention relates to a process for the manufacture of a bridge as well as to bridges and lift bridges manufactured according to said process.

In known processes for the manufacture of bridges, high expenditures for absorbing the dead weight of the bridge girder are necessary in the state of construction.

During the manufacture of the bridge girder on a falsework, expenditures arise for the foundation and the construction of the falsework.

During the manufacture of a bridge girder of concrete using a formwork carriage, the formwork carriage must be designed for absorbing the dead weight of the bridge girder. The formwork carriage is strained by the dead weight of the bridge girder via bending moments.

When the bridge girder of concrete or steel bridges is manufactured by incremental launching, additional expenditures for the bridge girder arise during the construction, since, during the launching, each cross-section of the bridge girder is exposed to positive and negative bending moments resulting from the load by dead weight. Therefore, bridges manufactured by incremental launching exhibit particularly high cross-sections and a particularly high input of material.

During the manufacture of the bridge girder by the balanced cantilever construction method, large negative bending moments arise in the states of construction as a result of the dead weight in the bridge girder. The large cantilever moments over the supports must be absorbed by cross-sections of a sufficient height.

During the manufacture of the bridge girder by the balanced cantilever construction method with stays from a pylori (cable-stayed bridges), those cantilever moments are avoided, and instead additional expenditures will arise for the construction of the pylori and the installation of the stays. The length of the front part sections in a balanced cantilever construction with stays is limited from 5 m to 10 m by the bending stresses.

During the construction of arched bridges, a high expenditure arises for the manufacture of the arch. In most cases, the arch is erected on a falsework or in a guyed balanced cantilever construction. A further method of erecting the arch is the arch folding process (BETON, issue 5, May 1984, p. 200). In said process, two concrete arch halves are produced in an approximately vertical position using climbing forms in order to dispense with the falsework or the stays, respectively, during the construction and hence to achieve a rapid progress of construction work. Upon completion, the arch halves are folded up using stay cables.

The manufacture of a girder for a roof construction in an approximately vertical position is described in JP 4237773. By slackening a stay cable, the girder articulated at its low end is rotated into a horizontal position. A similar process for manufacturing bridges is described in JP 3025107. Those two processes work in the manner known from a draw bridge. The length of the bridge girder is limited essentially to the length between the lower articulation and the upper retaining point. Said length may be slightly increased by a projection of the bridge girder beyond the pylori top.

Processes for manufacturing concrete bridges in an approximately vertical position are known from US 2004/0045253. Using a crane, a special assembly crane or a winch, the bridge girder is rotated into the approximately horizontal final position around a pivot joint, which may be arranged between two piers or in the abutment. Those processes are limited to bridge spans of up to approx. 40 m, since the stabilization of the freely projecting bridge girder requires complex additional measures against wind and earthquake forces in the state of construction. The rotation operation using a winch and an additional weight or using a special assembly crane is also too complex for wider spans and hence uneconomical.

It is the object of the invention to provide a process for the manufacture of bridges wherein the erection of a falsework can be omitted, wherein no or only very small bending stresses occur in the bridge girder during the manufacture of the bridge girder, which is suitable for the manufacture of bridges with long spans and which provides economical advantages over known processes.

Said object is achieved in that

- a pier, at least one bridge girder with end points and at least one supporting rod with end points are erected in an approximately vertical position,
- one end point of the supporting rod is hinged to the bridge girder, and either—according to a first variant—
- one end point of the supporting rod is hinged to a pier, the bridge girder is brought into an approximately horizontal position by an approximately vertical motion of the end point of the bridge girder on the pier and the moved end point of the bridge girder is connected to the pier, or—according to a second variant—
- one end point of the bridge girder is hinged to the pier, the bridge girder is brought into an approximately horizontal position by an approximately vertical motion of the end point of the supporting rod on the pier and the moved end point of the supporting rod is connected to the pier,
- that the projecting end point of the bridge girder is connected to an abutment or a further end point of a second bridge girder.

Advantageous advanced embodiments of the invention are defined in the subclaims.

According to the invention, an end point of the supporting rod abutting on the pier or an end point of the bridge girder abutting on the pier, respectively, which allows a swivelling movement, is also regarded as an articulation, wherein the adjacent parts are pressed against each other by forces, whereby a frictional connection is formed.

According to the invention, the supporting rod is understood to be not only a rod charged with compressive forces acting in the longitudinal direction, but also a rod subject to tensile stress, with the rod in any case being essentially free from any bending load.

According to the invention, the supporting rod can be manufactured on the bridge construction site, e.g., also by combining several strands into one cable.

A particular advantageous variant of the process is characterized in that the end points of the supporting rod are designed such that an angular rotation a relative to the bridge girder can occur in the end point and an angular rotation $\beta$ relative to the pier can occur in the end point and that the sum of the angular rotations $\alpha$ plus $\beta$ is larger than 85° and smaller than 260°.

A further suitable variant is characterized in that the end point of the supporting rod and the end point of the bridge girder are designed such that an angular rotation a relative to the bridge girder can occur in the end point and an angular rotation $\beta$ relative to the pier can occur in the end point and that the angular rotation $\alpha$ is larger than 100° and smaller than 175° and that the angular rotation $\beta$ is approximately 90°.

A lift bridge manufactured by the process according to the invention is characterized in that it is composed of at least one pier, one bridge girder and one supporting rod, that one end point of the supporting rod is hinged to the bridge girder, that one end point of the supporting rod or one end point of the bridge girder is connected to the pier and that the bridge girder can be rotated from the approximately horizontal position by moving an end point of the supporting rod or an end point of the bridge girder such that the structure clearance of the traffic route intersecting the bridge is enlarged.

The pier, the bridge girder and the supporting rod form a statically stable supporting framework. The connections of the bridge girder and the supporting rod to the pier are subject only to minor strains and can be produced with simple structural elements. In the process according to the invention, the load on the pier during the state of construction is smaller than with known bridge building processes with a horizontal manufacture of the bridge girder, since the area exposed to the wind is more convenient and the centre of mass significant for the determination of earthquake forces is located lower.

The manufacture of the bridge superstructure in an approximately vertical position is advantageous since thereby no or only very small bending moments occur during the manufacture as a result of the dead weight. This is a major advantage particularly for the manufacture of concrete bridges, since bending moments affecting the speed of the progress of construction work will occur during the conventional horizontal manufacture of the bridge girder. With the incremental launching method, a weekly cycle for the production of a phase of construction is usually achieved. With the balanced cantilever construction method or the manufacture on a falsework or using a formwork carriage, the times for producing a phase of construction range from one to three weeks.

With an approximately vertical manufacture, the concrete girder is exposed to much smaller strains and can thus be produced faster. The known sliding form or climbing form methods, which are used anyway for the manufacture of the concrete pier, may be used in the process according to the invention also for the manufacture of the bridge girder.

The bridge girder may be manufactured along with the pier, for example, via a climbing or sliding form. This substantially reduces the formwork expenditure, the production time and the costs.

The recommended process is to be used particularly advantageously for bridges with high piers. The range of spans for the application of the process according to the invention is between 20 m and 400 m, preferably between 50 m and 150 m. If the moved end point of the bridge girder or of the supporting rod is not firmly connected to the pier, the process may be used for the construction and operation of lift bridges.

In the following, the invention is described by way of exemplary embodiments illustrated in the drawings.

The invention is illustrated in FIG. 1 to FIG. 32.

Figure 15:
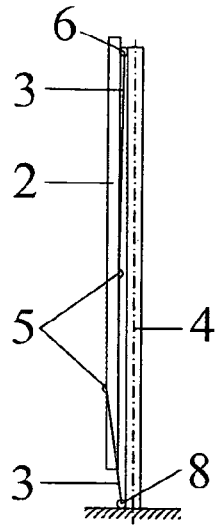
Figure 16:
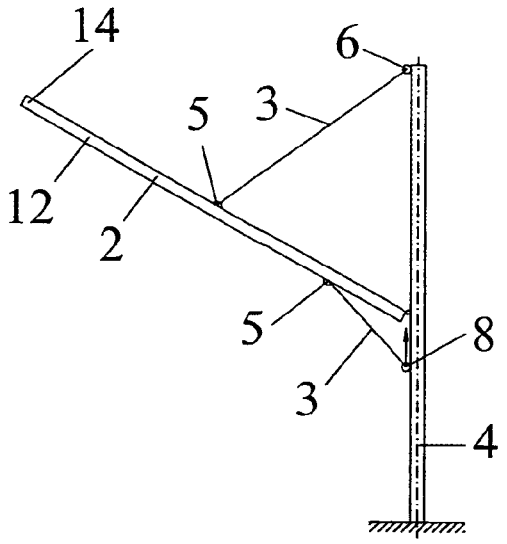
Figure 17:
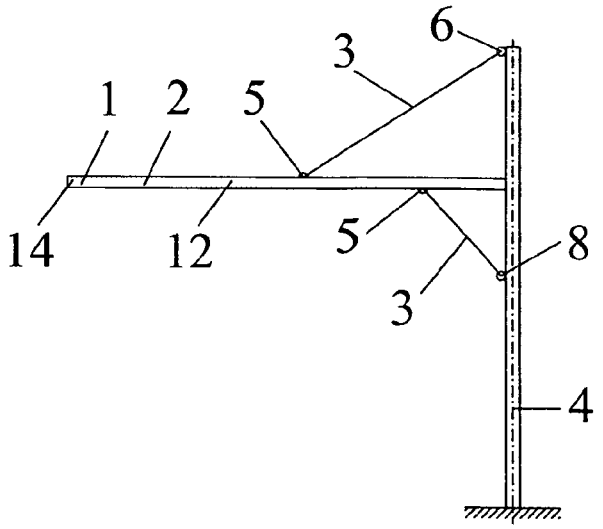
Figure 18:
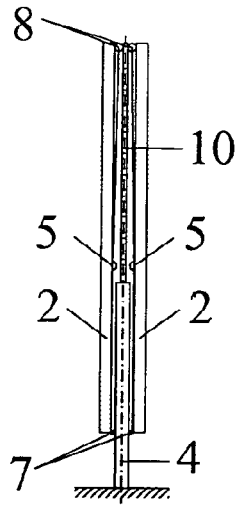
Figure 19:
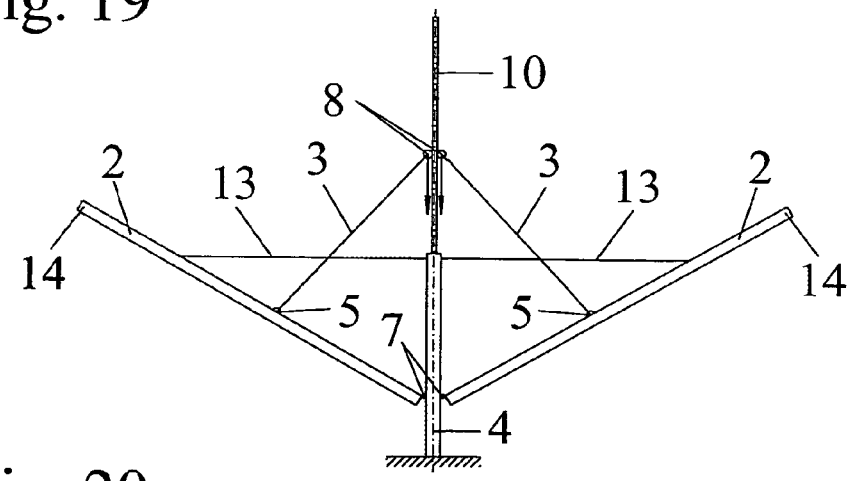
Figure 20:
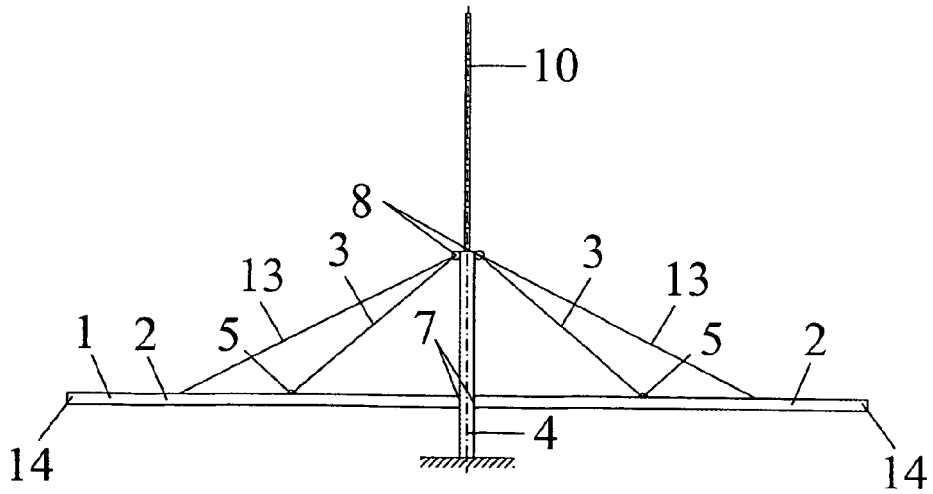
Figure 21:
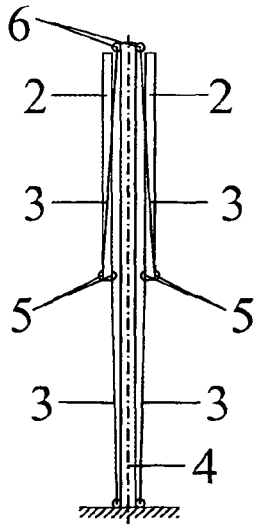
Figure 22:
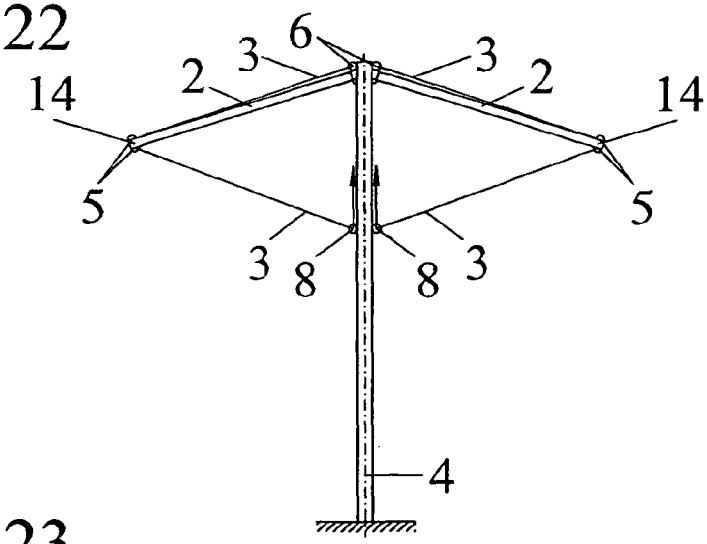
Figure 23:
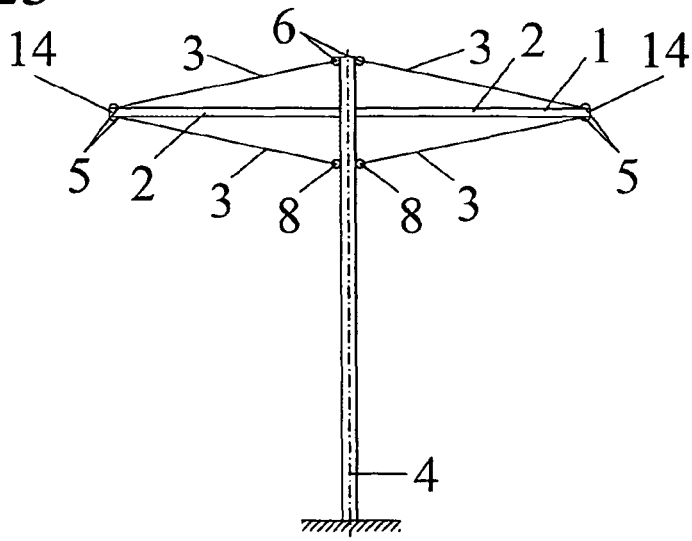
Figure 24:
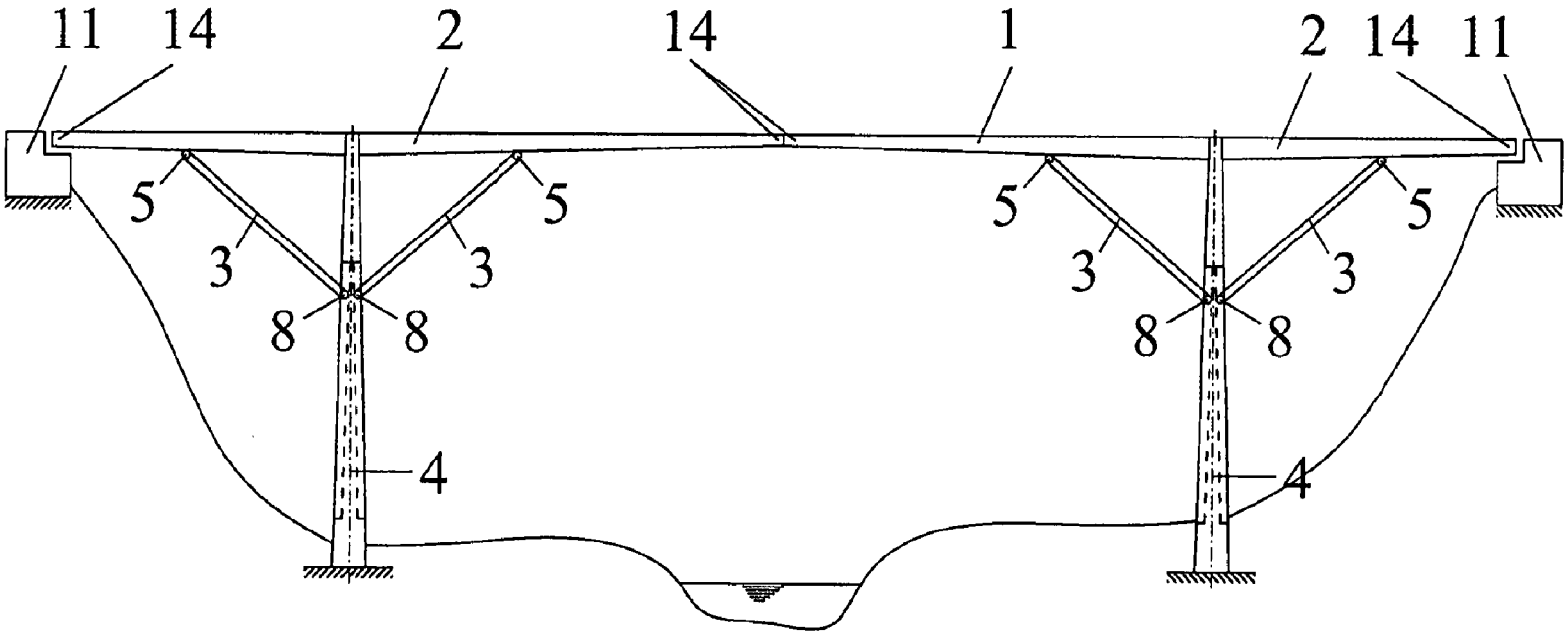
Figure 25:
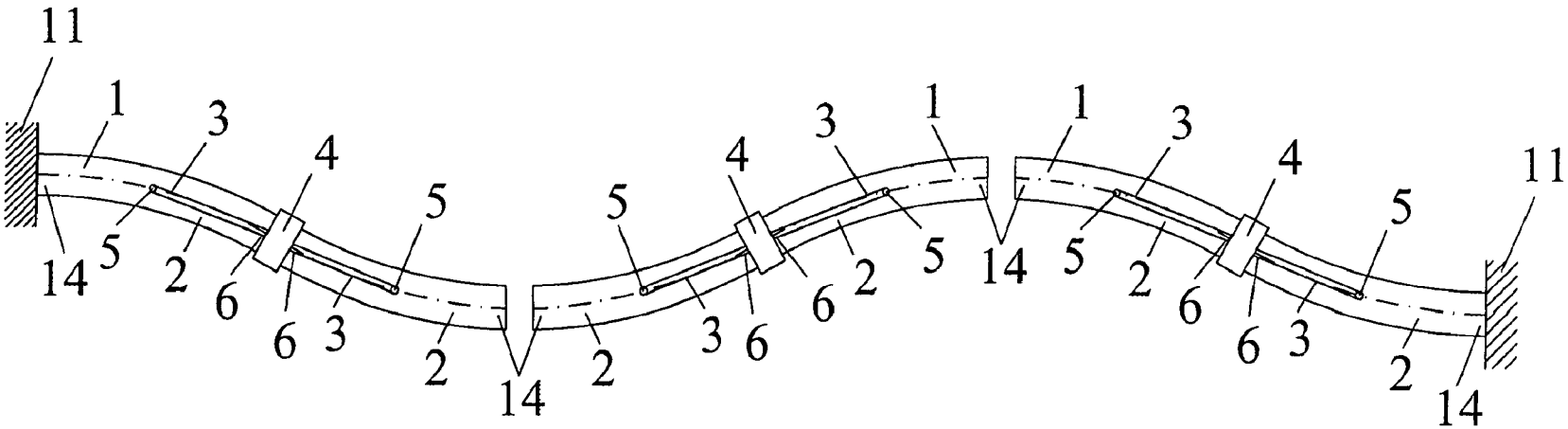
Figure 26:
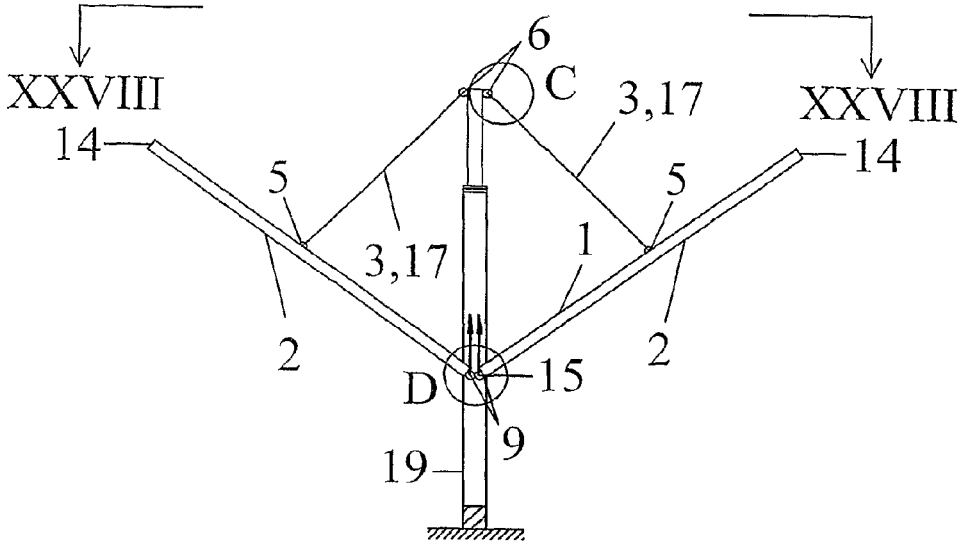
Figure 28:
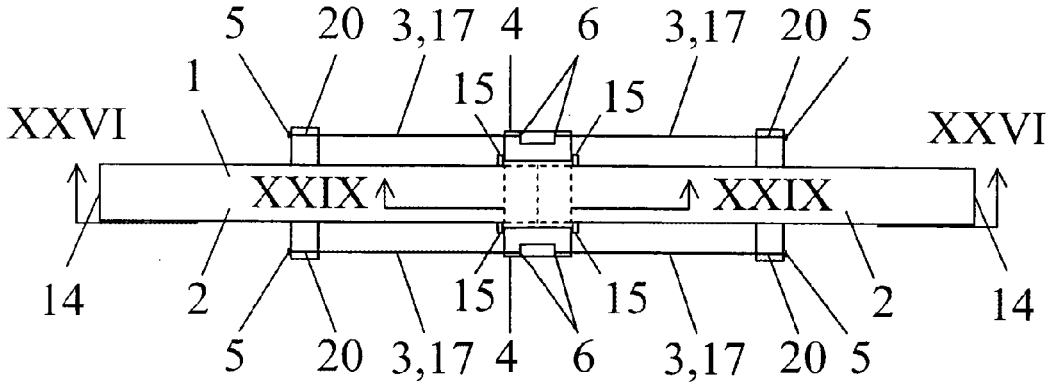

FIG. 15 shows a view of a fourth embodiment after the manufacture of the pier, the supporting rods and the bridge girders FIG. 16 shows a view of the fourth embodiment during the folding process FIG. 17 shows a view of the fourth embodiment upon completion of the folding process FIG. 18 shows a view of a fifth embodiment after the manufacture of the pier, the supporting rods and the bridge girders FIG. 19 shows a view of the fifth embodiment during the folding process FIG. 20 shows a view of the fifth embodiment upon completion of the folding process FIG. 21 shows a view of a sixth embodiment after the manufacture of the pier, the supporting rods and the bridge girders FIG. 22 shows a view of the sixth embodiment during the folding process FIG. 23 shows a view of the sixth embodiment upon completion of the folding process FIG. 24 shows a view of a finished bridge FIG. 25 shows a plan view of a bridge bent in the ground plan FIG. 26 shows a section of a seventh embodiment during the folding process along line XXVI-XXVI of FIG. 28

Figure 27:
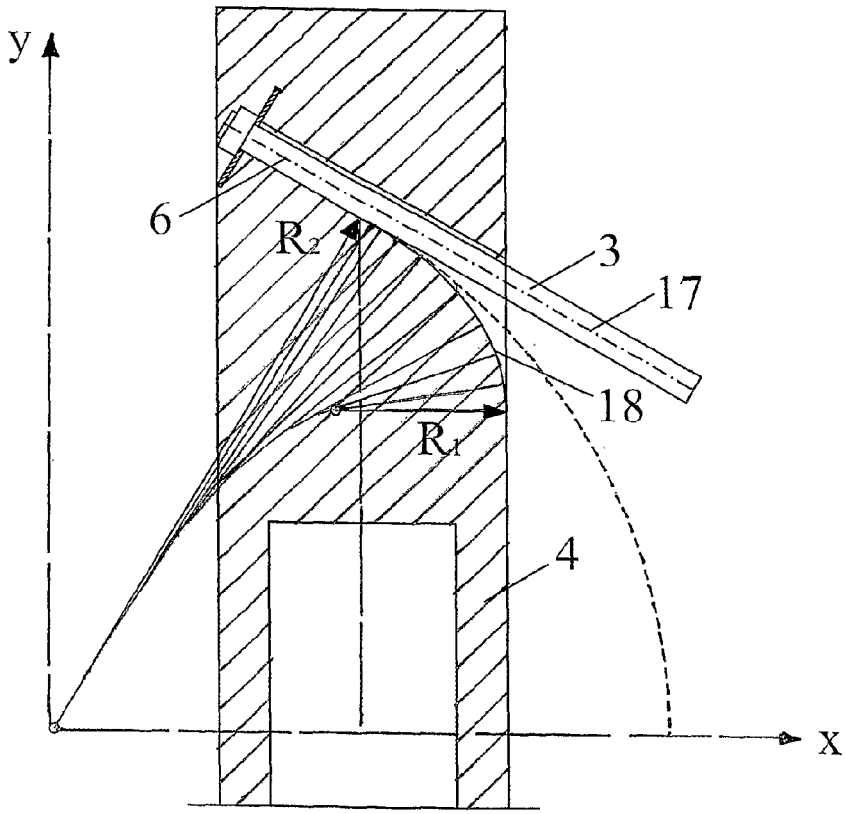

FIG. 27 shows detail C of FIG. 26

FIG. 28 shows a top view of the seventh embodiment during the folding process along line XXVIII-XXVIII of FIG. 26

Figure 29:
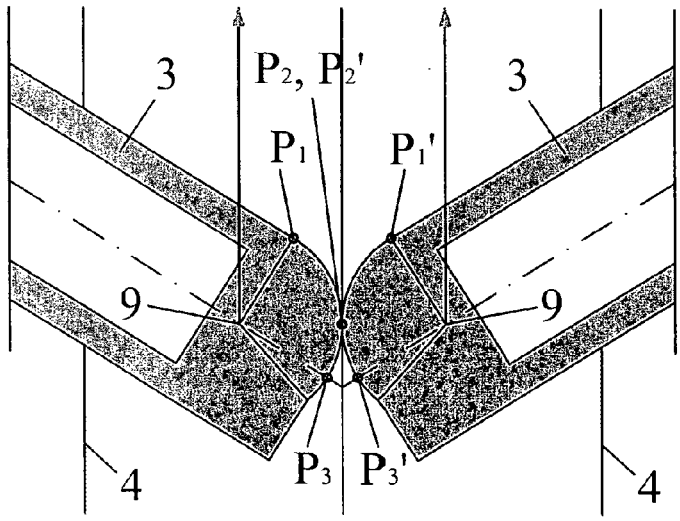

FIG. 29 shows detail D of FIG. 26 and simultaneously a section taken along line XXIX-XXIX of FIG. 28

Figure 30:
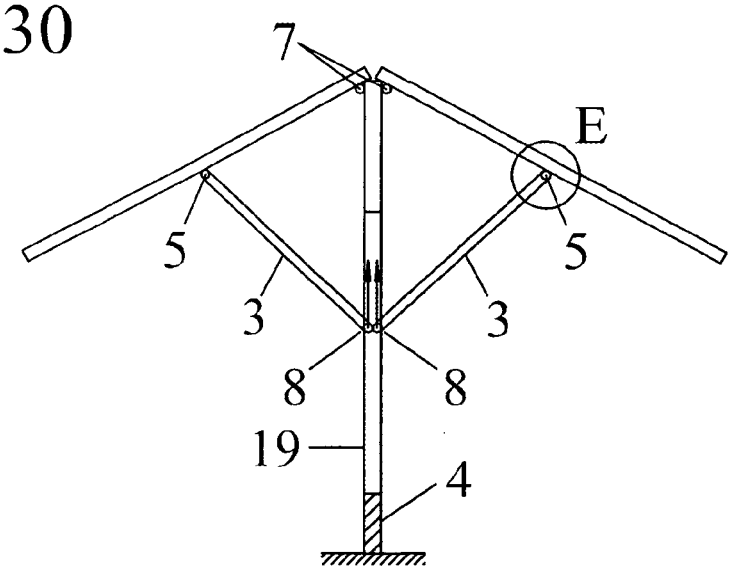

FIG. 30 shows a section of an eighth embodiment during the folding process

Figure 31:
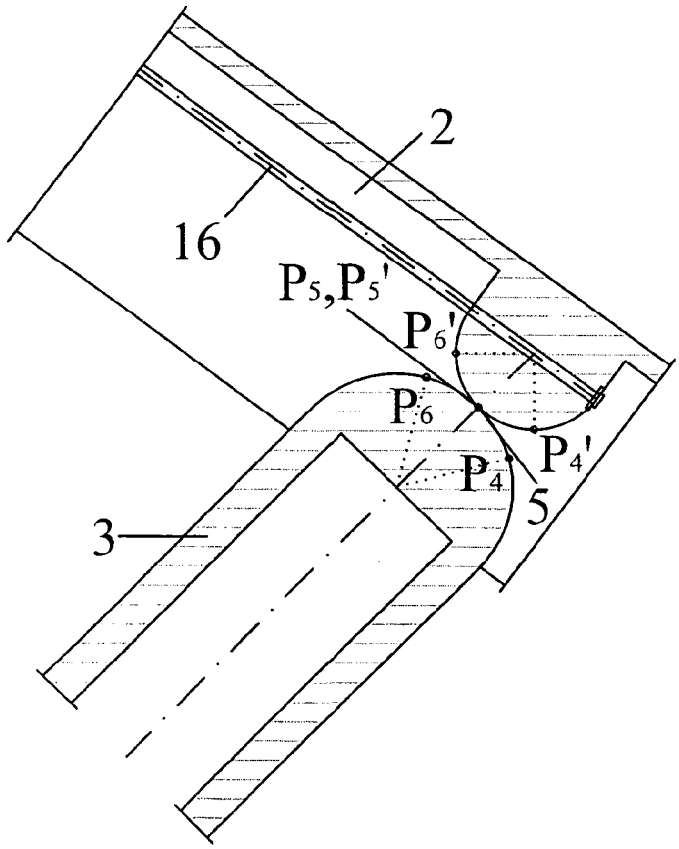

FIG. 31 shows detail E of FIG. 30

Figure 32:
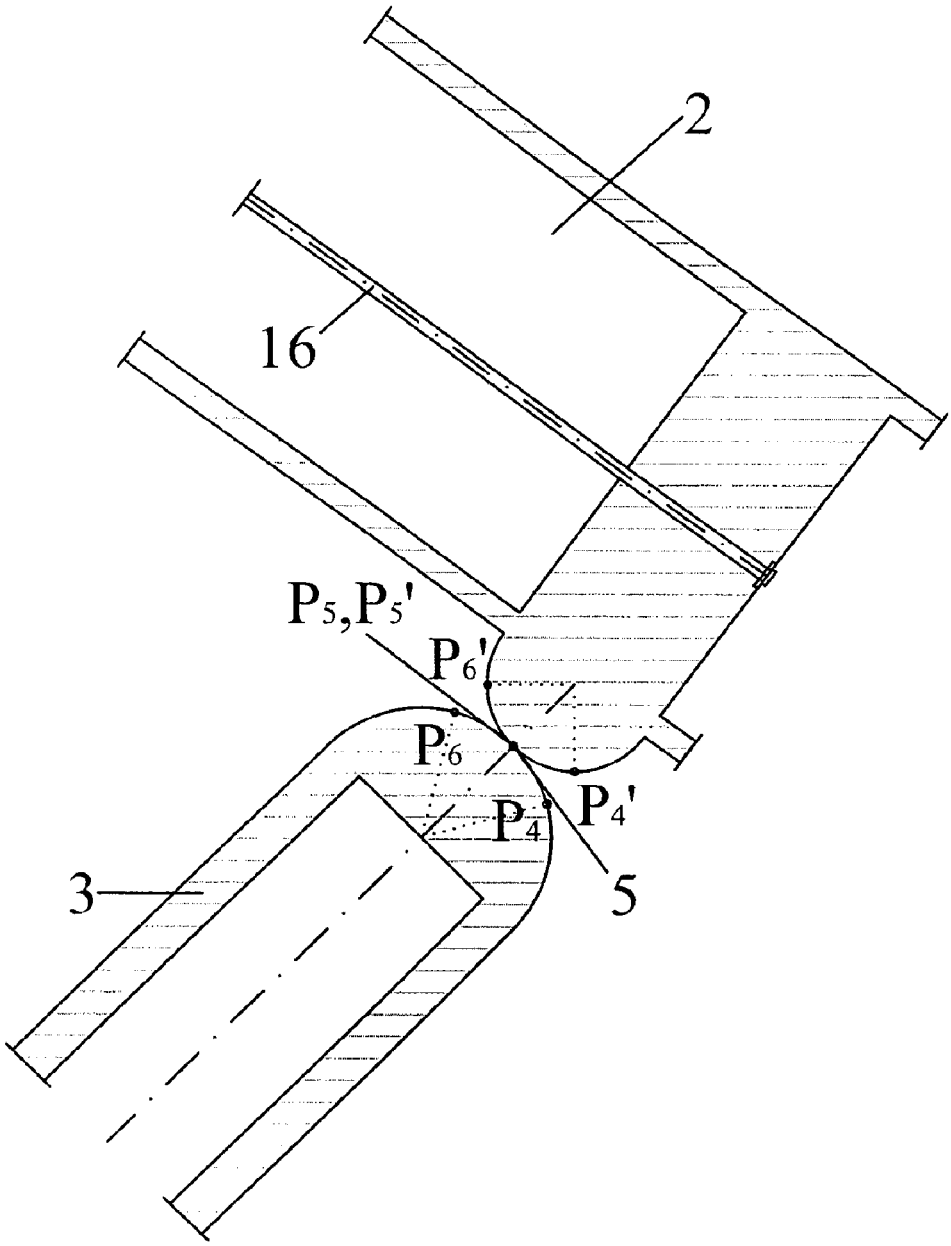

FIG. 32 shows an alternative embodiment of detail E of FIG. 30

A first embodiment of the process according to the invention is illustrated in FIG. 1 to FIG. 6.

Figure 1:
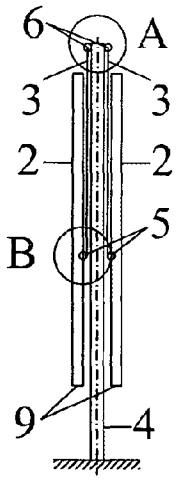
FIG. 1 shows a view of a first embodiment after the manufacture of the pier, the supporting rods and the bridge girders

According to FIG. 1, in a first step, the pier 4 and the bridge girders 2 are concreted in a vertical position. The formwork installation and concreting procedures for the bridge girders correspond with regard to their expenditure to the procedures for the manufacture of the pier 4, which enables substantial savings in comparison to a manufacture in a horizontal position.

In a second step, the supporting rods 3, which, in this example, consist of a cable made of strands, are installed.

According to FIG. 2, in the following step, the end points 9 of the bridge girders 2 are raised by conventional lifting devices, e.g., by hydraulic strand lifters and cables made of strands. The lifting devices may be positioned at the top of the pier 4. In that state, bending moments occur in the bridge girders 2, which, however, are smaller than in the final state depicted in FIG. 3. It may be advantageous to stress post-tensioning tendons in the bridge girder 2 during the folding process in order to counteract the moments occurring due to the dead weight.

The end point 9 of the bridge girder 2 may be equipped with rolls in order to permit almost frictionless lifting. Alternatively, a sliding layer may be provided in the pier 4. Known material combinations for shifting operations on a slideway are, for example, Teflon and steel or bronze and steel.

Figure 2:
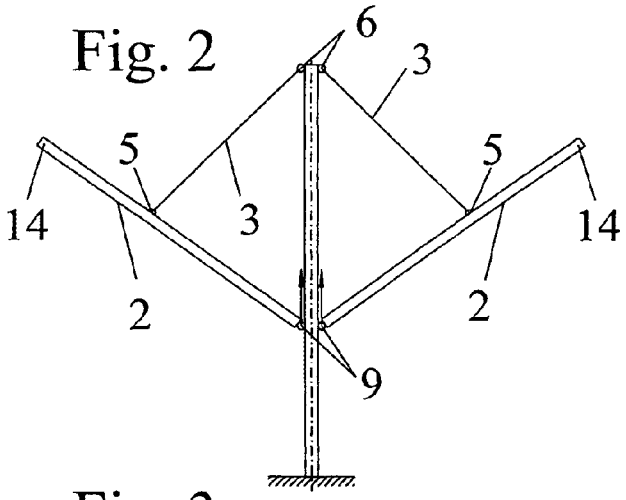
FIG. 2 shows a view of the first embodiment during the folding process

The lifting forces for the folding process illustrated in FIG. 2 are to be dimensioned for the dead weight of the bridge girders 2, the supporting rods 3 and the frictional forces occurring between the end points 9 of the bridge girder 2 and the pier 4.

It may also be beneficial for the state of construction to equip the bridge girder 2 in the state of construction only with the statically required cross-sections and to complete the cross-sectionin the final state, e.g., by producing a bridge deck.

Figure 4:
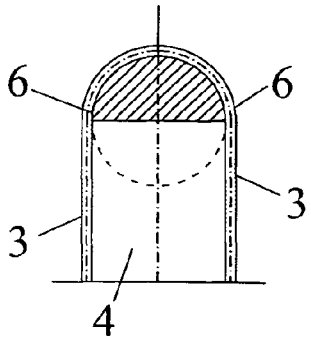
FIG. 4 shows detail A of FIG. 1
Figure 5:
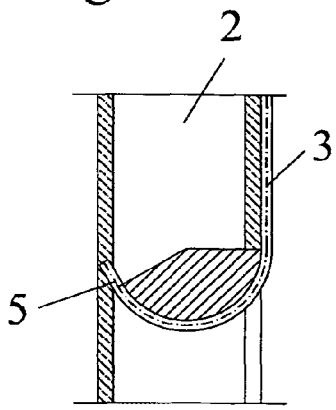
FIG. 5 shows detail B of FIG. 1
Figure 3:
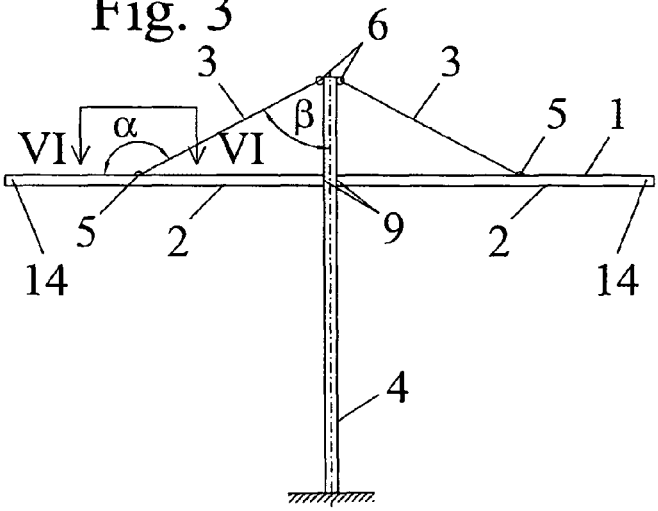
FIG. 3 shows a view of the first embodiment upon completion of the folding process

During the folding process illustrated in FIG. 2, the length of the bridge girders 2 and the supporting rods 3 is changed only by the elastic alternations of length as a result of the emerging normal forces. In this example, tensile forces occur in the supporting rods 3, and compressive forces occur in the bridge girders 2 between points 5 and 9. The supporting rods 3 are connected to the pier 4 in points 6 and to the bridge girders 2 in points 5. The design of the connection to the pier 4 is illustrated in FIG. 4 (detail A from FIG. 1), and the design of the connection to the bridge girder 2 is illustrated in FIG. 5 (detail B from FIG. 1). According to FIG. 5, the supporting rod 3 consisting of a strand cable is guided over a deflection structure in the box section of the bridge girder 2 during the folding process. Thereby, the angle of rotation $\alpha$ of approx. 150° can be accommodated in point 5 of the folding process. The angle of rotation $\beta$ in points 6 amounts to approx. 60° in each case and is accommodated at the top of the pier 4 by rolling off the supporting rods 3 over the saddle structure. The radii of curvature of the deflection structure in the box section in FIG. 4 and of the saddle in FIG. 5 are to be adjusted to the allowable radii of curvature of strand cables.

Figure 6:
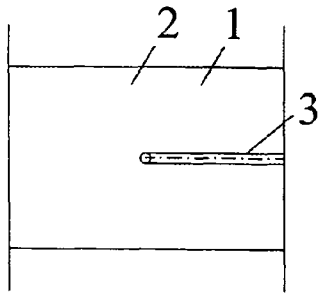
FIG. 6 shows a section taken along line VI-VI of FIG. 3

FIG. 6 shows a top view of a detail of the bridge girder 2 in the final position. In this example, the supporting rod 3 is arranged in the centre of the bridge girder 2 so that the lanes can be guided past the supporting rod 3 laterally.

The known arch folding process has the following disadvantages compared to the process according to the invention:

- The arch halves must be supported by stays during the construction and must be rotated during the state of construction in order to keep the bending stresses in the arch small. The approximately straight bridge girders 2 are concreted without a change in position and may be attached to the pier 4 without major efforts.
- The stay cables for folding up the arch halves release their tensile forces into foundation elements which have to be produced only for introducing those forces into the subsoil. The raising of the bridge girders 2 in the process according to the invention does not require any additional structural expenditures since the reaction forces due to the lifting process are passed to the pier 4.

A second embodiment of the process according to the invention is illustrated in FIG. 7 to FIG. 10.

Figure 7:
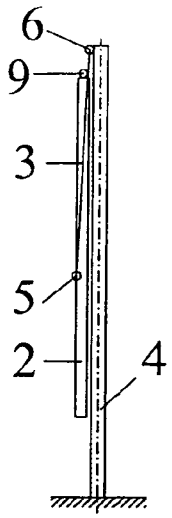
FIG. 7 shows a view of a second embodiment after the manufacture of the pier, the supporting rod and the bridge girder

According to FIG. 7, in a first step of the process, the pier 4 is manufactured from a suitable building material such as concrete, brickwork, steel or timber. In the following step, the bridge girder 2, which, in this example, may consist of steel or timber, is mounted in a vertical position. The bridge girder 2 may be composed of individual elements which are frictionally connected to each other in this position. The supporting rod 3 from a steel profile is mounted and hinged to the bridge girder 2 in point 5 and to the pier 4 in point 6.

Figure 8:
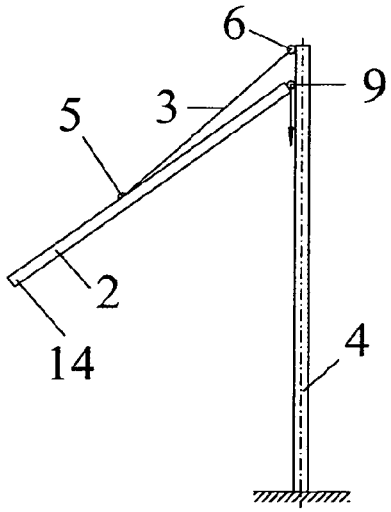
FIG. 8 shows a view of the second embodiment during the folding process
Figure 9:
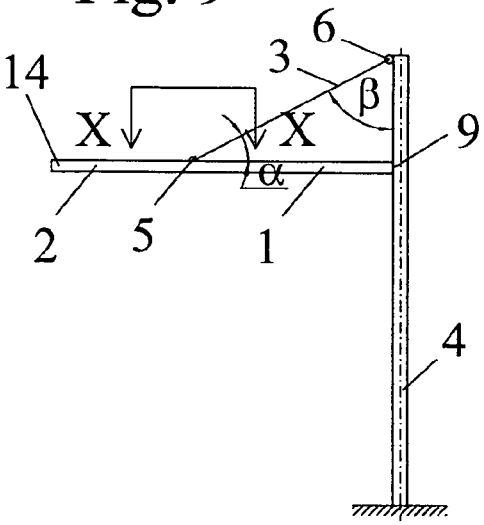
FIG. 9 shows a view of the second embodiment upon completion of the folding process

The rampant bridge 1 depicted in FIG. 9 is formed by lowering the end point 9 of the bridge girder 2 as illustrated in FIG. 8. A permanent rotation a occurs in end point 5 and a permanent rotation $\beta$ occurs in end point 6. The sum of the angles of rotation $\alpha$ plus $\beta$ equals 90°.

Figure 10:
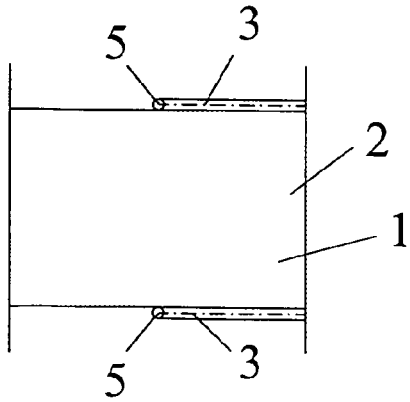
FIG. 10 shows a section taken along line X-X of FIG. 9

FIG. 10 shows a top view of a detail of the bridge girder 2 in the final position. In this example, the supporting rods 3 are arranged laterally of the bridge girder 2 so that the lanes can be guided past between the supporting rods 3.

A third embodiment of the process according to the invention is illustrated in FIG. 11 to FIG. 14.

Figure 11:
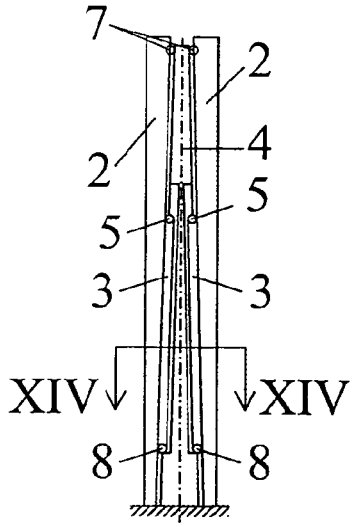
FIG. 11 shows a view of a third embodiment after the manufacture of the pier, the supporting rods and the bridge girders

According to FIG. 11, in a first step of the process, the pier 4 is manufactured from concrete. The pier 4 has a constant width, but a variable thickness across the height. In this example, the bridge girders 2 are erected on the foundation plate of the pier 4. The bridge girders 2 have a constant width, but a variable cross-sectional height. Advantageously, the pier 4, the supporting rods 3 and the bridge girders 2 are manufactured simultaneously, e.g., using climbing forms. The supporting rods 3 are connected to the bridge girders 2 in points 5. The bridge girders 2 are connected to the pier 4 in points 7.

Figure 12:
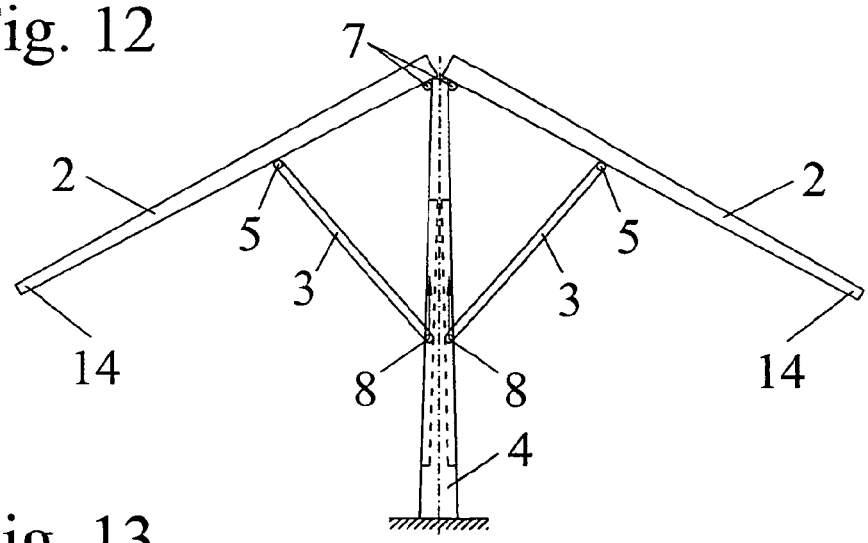
FIG. 12 shows a view of the third embodiment during the folding process
Figure 13:
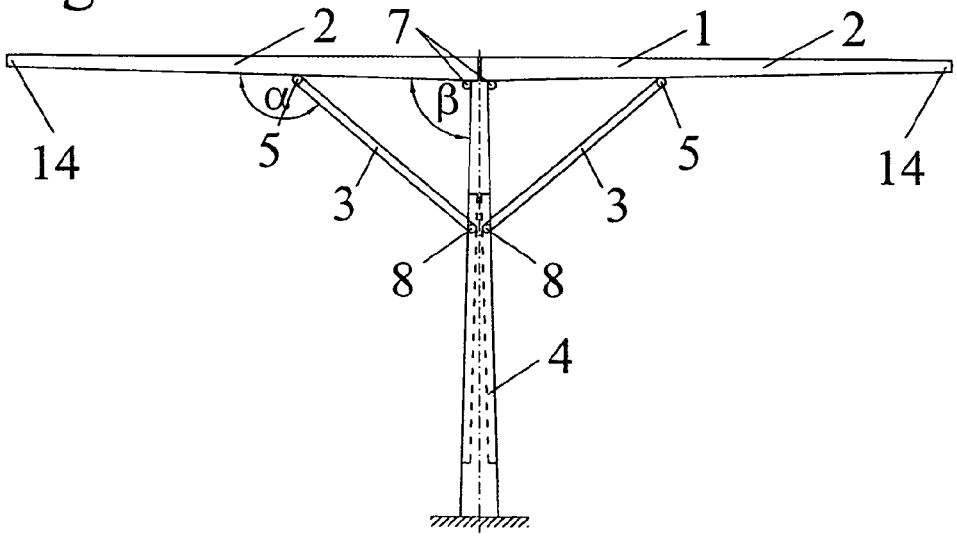
FIG. 13 shows a view of the third embodiment upon completion of the folding process

It may be suitable to push the end points 5 of the supporting rods 3 away from the pier 4 approximately horizontally before the lifting is started. The bridge 1 depicted in FIG. 13 is finally formed by raising the end points 8 of the supporting rods 3 as illustrated in FIG. 12.

During the folding process, an angular rotation $\alpha$ of 140° occurs in the end point 5 of the supporting rod 3. An angular rotation $\beta$ of 90° occurs in the end point 7 of the bridge girder 2. The permanent angular rotations in the end points 5 and 7 can be absorbed by structural formations common in concrete construction, for example, by concrete joints or by the bending of reinforcement bars.

By filling the gap between the two bridge girders 2 with grouting concrete and installing continuity tension members, the bridge 1 exhibits a flexurally rigid connection over the top of the pier 4.

Figure 14:
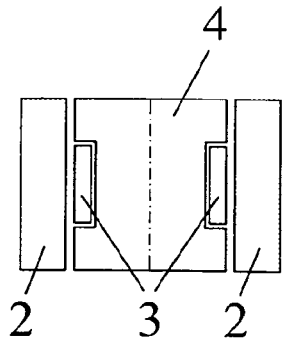
FIG. 14 shows a section taken along line XIV-XIV in FIG. 11

In FIG. 14, it is illustrated how the supporting rods 3 can advantageously be installed in the mould of the pier 4 in order to allow quick manufacture of the pier 4, the supporting rods 3 and the bridge girders 2.

A fourth embodiment of the process according to the invention is illustrated in FIG. 15 to FIG. 17.

According to FIG. 15, the pier 4, the bridge girders 2 and the supporting rods 3 are erected in an approximately vertical position. In this example, a supporting rod 3 is connected to the bridge girder 2 in point 5 and to the pier 4 in point 6. The second supporting rod 3 is connected to the bridge girder 2 in point 5. According to FIG. 16, the second end point 8 of said supporting rod 3 is raised. The raising causes the bridge girder 2 to be rotated from the approximately vertical position into a horizontal position, which is illustrated in FIG. 17.

If the end point of the bridge girder 2, which end point is located beside the pier 4 in this position, is not firmly connected to the pier 4, the bridge 1 can be used as a lift bridge 12. By lowering point 8 in FIG. 17, the bridge girder 2 is moved upwards so that the structure clearance of the traffic route intersecting the bridge 1 is enlarged.

A fifth embodiment of the process according to the invention is illustrated in FIG. 18 to FIG. 20.

According to FIG. 18, in a first step, the pier 4, the auxiliary pier 10, the bridge girders 2 and the supporting rods 3 are manufactured in a vertical position. In this position, the end points 8 of the bridge girders 2 are located higher than the top of the pier 4. Therefore, the installation of an auxiliary pier 10 is required. The bridge girders 2 are connected to the pier 4 in points 7. The supporting rods 3 are connected to the bridge girders 2 in points 5.

According to FIG. 19, the other end points 8 of the supporting rods 3 are lowered by the auxiliary pier 10. In order to reduce the bending moments in the bridge girders 2 during lowering, stays 13 are used in this example. Those stays 13 may consist of strand cables which are connected to the bridge girder 2 and are loaded with a particular force, for example, from the top of the pier 4. The length of the stays 13 increases during the rotation of the bridge girders 2, which can be ensured without any problems by guiding the strand cables along.

In the final position according to FIG. 20, the auxiliary pier 10 can be removed or used for the installation of additional cables for supporting the bridge girders 2. The stays 13 may remain as permanent cables in the bridge 1 or may be replaced by stay cables.

A sixth embodiment of the process according to the invention is illustrated in FIG. 21 to FIG. 23.

According to FIG. 21, the pier 4, the bridge girders 2 and the supporting rods 3 are manufactured in an approximately vertical position.

The bridge 1 depicted in FIG. 23 is finished by raising the end points 8 of the supporting rods 3 according to FIG. 22.

FIG. 24 shows a bridge 1 comprising two abutments 11, two piers 4, four bridge girders 2 and four supporting rods 3. The view of the bridge 1 in FIG. 24 shows how the process can be used advantageously for the manufacture of viaducts. The end points 14 of the bridge girders 2 in the middle of the main span of the bridge 1 are interconnected in a flexurally rigid manner in the final state. The two other end points 14 of the bridge girder are connected to the abutment 11. The supporting rods 3 may subsequently be removed if required, for example, for creative reasons.

The process according to the invention can also be used for the manufacture of bridges bent in the ground plan, as is shown in FIG. 25 for a bridge with four spans. In this example, the bridge girders 2 must be supplemented with connecting pieces in order to finish the bridge 1.

A seventh embodiment of the process is illustrated in FIGS. 26 to 29. FIG. 26 shows a state during the raising of the end points 9 of the bridge girders 2. In this example, the pier 4 has an opening 19 extending along the height of the pier.

The design of the connection of the supporting rod 3 to the pier 4 is illustrated in FIG. 27 (detail C from FIG. 26). For the sake of clarity, only the supporting rod 3 leading to the right is plotted in FIG. 27. The supporting rod 3 may consist of a stay cable 17, and several stay cables 17 may be arranged one after the other. At the beginning of the lifting process, the supporting rod 3 runs approximately vertically along the pier 4 to the end point 5, where it is connected to the bridge girder 2. At the beginning of the lifting process, the force in the supporting rod 3 is much smaller than in the final state. This fact is taken into account by the design of the deflection saddle 18 for the supporting rod 3 in FIG. 27. The contact pressure of the supporting rod 3 in the deflection saddle 18 can be calculated from the tensile force of the supporting rod 3 divided by the product of deflection radius and width of the supporting rod 3. In a design of the deflection saddle according to FIG. 27 with a small radius $R_1$ at the beginning of the lifting process and a larger radius $R_2$ upon completion of the lifting process, wherein $R_2$ is calculated from $R_1$ multiplied by the ratio of the tensile forces in the supporting rod at the end and at the beginning of the lifting process, the contact pressure on the supporting rod 3 caused by the deflection saddle 18 is constant during the lifting process, if the radii of the deflection saddle 18, which are located between $R_1$ and $R_2$, are calculated according to the forces arising in the supporting rod 3.

FIG. 28 shows a top view of the bridge 1 during the lifting process. The pier 4 is designed with an opening 19 so that the bridge girders 2 contact each other during the lifting process and the emerging compressive forces in the rolling contact joints are transmitted via Hertzian stresses. In the example according to FIG. 28, the cross-section of the bridge girders 2 is a box section. In order to keep the weight of the bridge girders 2 small during the lifting process, the projecting parts of the bridge floor are produced only after completion of the lifting process. Therefore, crossbeams are required in the end points 5 of the supporting rods 3 connected to the bridge girders 2. The stabilization of the bridge girders 2 during the lifting process can be effected with suitable devices 15, e.g., roller bearings.

The design of the connection of the bridge girders 2 is illustrated in FIG. 29 (detail D from FIG. 26). At the beginning of the lifting process, the bridge girders 2 contact each other in lines $P_1$ and $P_1'$. In the position of the bridge girders 2 as illustrated in FIG. 29, the contact occurs in lines $P_2$ and $P_2'$. In the final state, the contact will occur in $P_3$ and $P_3'$. In the example according to FIG. 29, the ends of the bridge girders 2 are designed with circularly bent steel sheets which are connected to the concrete of the bridge girders 2 with dowels or a welded-on reinforcement. During the lifting process, increased pressing, referred to as Hertzian stress, occurs in the ends of the bridge girders 2, which ends are formed in the shape of circular cylinders, along the tangent lines, e.g., $P_2$ and $P_2'$ in FIG. 29. The radii of the end regions of the bridge girders 2 are to be dimensioned for the Hertzian stresses arising during the lifting process. The radius for the ends of the bridge girders 2 in FIG. 28 is constant. However, it could also be adjusted to the forces arising in the bridge girders 2 and increase, for example, from a smaller radius in lines $P_1$, $P_1'$ to a larger radius in lines $P_3$, $P_3'$ in order to obtain an approximately constant Hertzian stress in the contact lines during the lifting process.

An eighth embodiment of the process is illustrated in FIGS. 30 to 32. FIG. 30 shows a state during the raising of the end points 8 of the supporting rods 3. The pier 4 has an opening 19 extending along the height of the pier.

The design of the connection of the supporting rod 3 to the bridge girder 2 is illustrated in FIG. 31 (detail E from FIG. 30). The mutual rotation of the supporting rod 3 and the bridge girder 2, which, in this example, amounts to approx. 150° during the lifting process, is accomplished by rolling off along cylindrical contact surfaces. At the beginning of the lifting process, the contact occurs along lines $P_4$, $P_4'$. In FIG. 31, a state is illustrated in which the contact between the supporting rod 3 and the bridge girder 2 occurs along lines $P_5$, $P_5'$. Upon completion of the lifting process, the load transmission between the bridge girder 2 and the supporting rod 3 will occur along lines $P_6$, $P_6'$. In FIG. 31, an external post-tensioning tendon 16 is depicted, which is arranged in the axis through the centre of gravity of the bridge girder 2 designed with a T-beam cross-section. During the lifting process, the external post-tensioning tendon is pretensioned such that no or only small tensile forces will arise in the bridge girder 2.

An alternative embodiment for the connection of the supporting rod 3 to the bridge girder 2 (detail E from FIG. 30) is illustrated in FIG. 32. The bridge girder of this alternative embodiment exhibits a box section. The mutual rotation in the end point 5 between the supporting rod 3 and the bridge girder 2 occurs outside of the box section of the bridge girder 2. The offset moment resulting therefrom produces bending stresses in the bridge girder 2, which are to be considered for the dimensioning of the bridge girder 2. The external post-tensioning tendon 16 is arranged in the axis through the centre of gravity of the box section of the bridge girder 2.

With supporting rods 3 subject to compressive stress, the span of a bridge 1 between two piers 4 which is obtainable by the process according to the invention corresponds to the sum of the heights of the two piers 4. The application of the process for supporting rods 3 subject to tensile stress permits the manufacture of a bridge 1 having a span which is larger than the sum of the pier heights.

Preferably, the process is suitable for the manufacture of bridges made of prestressed concrete and reinforced concrete, but can also be used for steel bridges, steel—concrete—composite bridges, timber bridges or bridges made of synthetic materials.

It may also be advantageous to combine different building materials. For example, a bridge girder 2 could be manufactured from prestressed concrete, and the top of the bridge girder 2 beside the end point 14 could consist of a streel structure in order to reduce the dead weight of the cantilevering part and thereby the cantilever moments in the state of construction.

Correspondingly, the process according to the invention can also be used in building engineering and civil engineering, if it is advantageous to produce girders in an approximately vertical position and to rotate them subsequently into an approximately horizontal final position.

The invention claimed is:

1. A process for the manufacture of a bridge, comprising:

erecting a pier, at least one bridge girder with end points and at least one supporting rod with end points in an approximately vertical position;

hinging one end point of the supporting rod to the bridge girder;

performing at least one of:

hinging another end point of the supporting rod to the pier, the bridge girder being brought into an approximately horizontal position by an approximately vertical motion of one end point of the bridge girder on the pier, said one end point of the bridge girder being connected to the pier; and hinging another end point of the bridge girder to the pier, the bridge girder being brought into an approximately horizontal position by an approximately vertical motion of an end point of the supporting rod on the pier, said end point of the supporting rod being connected to the pier; and then connecting projecting end point of the bridge girder to an abutment or a further end point of a second bridge girder; and then connecting projecting end point of the bridge girder to an abutment or a further end point of a second bridge girder.

2. A process for the manufacture of a bridge according to claim 1, wherein bridge girders and supporting rods are arranged on both sides of the pier and the two end points of supporting rods on the pier or the two end points of the bridge girder on the pier are moved approximately vertically.

3. A process for the manufacture of a bridge according to claim 1, wherein the bridge girder is manufactured with a variable cross-sectional height.

4. A process for the manufacture of a bridge according to claim 1, wherein the bridge girder is manufactured with a curvature in the elevation in the approximately horizontal final position.

5. A process for the manufacture of a bridge according to claim 1, wherein the bridge girder is manufactured with a curvature in the ground plan in the approximately horizontal final position.

6. A process for the manufacture of a bridge according to claim 1, wherein the pier is integrated into the abutment.

7. A process for the manufacture of a bridge according to claim 1, wherein the moved end points of the supporting rods and of the bridge girders, respectively, contact each other while the end points are being moved.

8. A process for the manufacture of a bridge according to claim 1, wherein the pier is manufactured with an opening extending along the height of the pier, in which the end points of the supporting rods or the bridge girders support each other while being moved, with the opening being delimited downwards and upwards by the pier.

9. A process for the manufacture of a bridge according to claim 1, wherein the compressive forces in the end points are transmitted via rolling contact joints during the movement of the supporting rod and the bridge girder.

10. A process for the manufacture of a bridge according to claim 1, wherein the surfaces of the rolling contact joints are formed from thin-walled, bent steel sheets which are backfilled with concrete in the end points of the supporting rods or the bridge girders.

11. A process for the manufacture of a bridge according to claim 1, wherein the radius of a rolling contact joint is not constant, but is adjusted to the compressive stress such that a small radius is provided for small strains and a larger radius is provided for larger strains.

12. A process for the manufacture of a bridge according to claim 1, wherein a supporting rod subject to tensile stress is provided as a stay cable and the tensile forces in the end points are transferred into the bridge girder and the pier via deflection saddles during the movement of the supporting rod.

13. A process for the manufacture of a bridge according to claim 1, wherein the radius of the deflection saddle is not constant, but is adjusted to the tensile stress of the supporting rod such that a small radius is provided for small strains and a larger radius is provided for larger strains.

14. A process for the manufacture of a bridge according to claim 1, wherein two end points of supporting rods or bridge girders are moved approximately vertically and that, during the movement, the end points are supported against the pier with a stabilizing device.

15. A process for the manufacture of a bridge according to claim 1, wherein the end points and of the supporting rod are designed such that an angular rotation $\alpha$ relative to the bridge girder can occur in the one end point and an angular rotation $\beta$ relative to the pier can occur in the other end point and that the sum of the angular rotations a plus $\beta$ is larger than 85° and smaller than 260°.

16. A process for the manufacture of a bridge according to claim 1, wherein the end point of the supporting rod and the end point of the bridge girder are designed such that an angular rotation $\alpha$ relative to the bridge girder can occur in the end point and an angular rotation $\beta$ relative to the pier can occur in the end point and that the angular rotation $\alpha$ is larger than 100° and smaller than 175° and that the angular rotation $\beta$ is approximately 90° .

17. A process for the manufacture of a bridge according to claim 1, wherein tension members made of strands and hydraulic strand lifters are used for raising the end points.

18. A Tilt lift bridge, manufactured by a process according to claim 1, wherein:

the lift bridge includes at least one pier, one bridge girder and at least one supporting rod; and the bridge girder can be rotated from the approximately horizontal position by moving an end point of the supporting rod or an end point of the bridge girder such that the structure clearance of the traffic route intersecting the bridge is enlarged.

19. A Tilt lift bridge according to claim 18, wherein the pier is integrated in the abutment.

* * * * *